US010378195B2

(12) United States Patent
Urata et al.

(10) Patent No.: US 10,378,195 B2
(45) Date of Patent: Aug. 13, 2019

(54) FLUSH TOILET

(71) Applicant: TOTO LTD., Kitakyushu-shi, Fukuoka (JP)

(72) Inventors: Shinichi Urata, Kitakyushu (JP); Keisuke Okada, Kitakyushu (JP)

(73) Assignee: Toto Ltd., Kitakyushu-shi, Fukuoka (JP)

( * ) Notice: Subject to any disclaimer, the term of this patent is extended or adjusted under 35 U.S.C. 154(b) by 1 day.

(21) Appl. No.: 15/007,746

(22) Filed: Jan. 27, 2016

(65) Prior Publication Data

US 2016/0222641 A1 Aug. 4, 2016

(30) Foreign Application Priority Data

Feb. 4, 2015 (JP) ..... 2015-020446

(51) Int. Cl.
*E03D 11/08* (2006.01)

(52) U.S. Cl.
CPC ..... *E03D 11/08* (2013.01); *E03D 2201/40* (2013.01)

(58) Field of Classification Search
CPC ..... E03D 11/08; E03D 2201/40
USPC ..... 4/420
See application file for complete search history.

(56) References Cited

U.S. PATENT DOCUMENTS 7,661,153 B2 * 2/2010 Nakamura ..... E03D 11/08 4/420
7,827,628 B2 11/2010 Ichiki et al.
8,037,552 B2 * 10/2011 Ichiki ..... E03D 11/08 4/420
9,157,225 B2 * 10/2015 Kashirajima ..... E03D 11/00
2007/0061955 A1 3/2007 Asada et al.
2013/0047329 A1 2/2013 Yamasaki et al.
2014/0289947 A1 10/2014 Hirakawa et al.
2014/0289948 A1 10/2014 Kitaura et al.
2015/0152628 A1 * 6/2015 Hirai ..... E03D 5/00 4/420

FOREIGN PATENT DOCUMENTS

EP 1847656 10/2007
EP 2562315 2/2013
WO 2006085575 A1 6/2008

OTHER PUBLICATIONS

Extended European Search Report for European Application No. EP 16152974.8, dated Jul. 7, 2016, 8 pages.

* cited by examiner

*Primary Examiner* — Erin Deery
*Assistant Examiner* — William R Klotz
(74) *Attorney, Agent, or Firm* — Brooks Kushman P.C.

(57) ABSTRACT

A flush toilet having a bowl portion including a waste receiving surface, a rim portion, a shelf portion, and a concave portion; a discharge passage for discharging waste; a first spout port for spouting flush water on a shelf portion of the bowl portion to form a circulating flow; a second spout port for spouting flush water in the same direction as the circulating direction of flush water spouted from a first spout port and toward the rear of the bowl portion; a first water conduit for supplying flush water to the first spout port; and a second water conduit for supplying flush water to the second spout port. The first and second water conduits are formed so that the flow rate of flush water spouted from the second spout port is greater than the flow rate of flush water spouted from the first spout port.

6 Claims, 7 Drawing Sheets

FLUSH TOILET

CROSS-REFERENCE TO RELATED APPLICATIONS

This application claims priority to JP application JP 2015-020446 filed on Feb. 4, 2015, the disclosure of which is incorporated in its entirety by reference herein.

TECHNICAL FIELD

The present invention relates to a flush toilet, and in particularly to a flush toilet for flushing a toilet and discharging waste by using flush water supplied from a flush water source.

BACKGROUND

Conventionally, as disclosed in JP5553188 (Patent Document 1), for example, known a toilet comprising a bowl-shaped waste receiving surface, a rim portion positioned at the top edge, and a concave portion formed at the bottom of the waste receiving surface, wherein the concave portion has: a bowl portion comprising a bottom surface positioned below a pooled water level, and a wall surface connecting the bottom surface and the bottom edge portion of the waste receiving surface; a first rim spout portion, positioned on one side of the bowl portion in the left-right direction, for spouting flush water toward the front of the bowl portion to form a circulating flow along the inside perimeter surface of the rim portion; a second rim spout portion, positioned on the other side of the bowl portion in the left-right direction and spouting flush water onto the inside perimeter surface of the rim portion to form a circulating flow in the same direction as the circulating flow created by the first rim spout portion; and a discharge pipe, the intake of which is connected to the concave portion, for discharging waste. In a flush toilet with such a structure, the main flow of flush water spouted from the first rim spout portion flows into the concave portion from the front side of the bowl portion; flush water spouted from the second rim spout portion flows into the main flow from a lateral direction within the concave portion of the bowl portion, and as a result of these, pooled water inside the concave portion is stirred up and down and floating waste inside the bowl portion can sink within the pooled water and can be efficiently discharged into a discharge pipe, so that waste discharging performance is improved.

SUMMARY

Technical Problems

In a flush toilet such as that set forth in Patent Document 1, flush water spouted from the second rim spout portion and flowing into the concave portion merges from the bowl portion side with flush water spouted from the first rim spout portion and flowing into the concave portion, leading to the problem of reduced ability to create an up and down circulating flow by stirring pooled water in the concave portion up and down.

An additional problem was the difficulty of forming a circulating flow in the vertical direction, since an effort is made to make flush water flowing from the second rim spout portion into the concave portion from the lateral direction merge with main flow flush water spouted from the first rim spout portion and flowing into the concave portion from the front side of the bowl portion.

The present invention was therefore undertaken to resolve these problems with the conventional art, and has the object of providing a flush toilet capable of promoting stirring in the up-down direction within the concave portion of the bowl portion to improve waste discharge performance.

Solution to Problems

To achieve the aforementioned object, the present invention is a flush toilet for flushing a toilet and discharging waste by using flush water supplied from a flush water source, comprising: a bowl portion including a bowl-shaped waste receiving surface, a rim portion formed at a top portion of the waste receiving surface, a shelf portion formed between the rim portion and the waste receiving surface, and a concave portion formed at a bottom of the waste receiving surface; a discharge passage for discharging waste, an inlet of the discharge passage being connected to a bottom of the bowl portion; a first spout port portion for spouting flush water toward a front of the bowl portion onto the shelf portion of the bowl portion to form a circulating flow; a second spout port portion for spouting flush water toward a rear of the bowl portion in a same direction as the circulating direction of flush water spouted from the first spout port portion; a first water conduit connected to the flush water source for supplying flush water to the first spout port portion; and a second water conduit, connected to the flush water source, for supplying flush water to the second spout port portion; wherein the first water conduit and second water conduit are formed so that flow rate of flush water spouted from the second spout port portion is greater than flow rate of flush water spouted from the first spout port portion.

In the present invention thus constituted, the second spout port portion spouts flush water toward the back of the bowl portion, and is formed so that the flow rate of flush water spouted from the second spout port portion is greater than the flow rate of flush water spouted from the first spout port portion, therefore flush water spouted from the second spout port portion is the main flow, and the main flow flows directly from the back of the concave portion of the bowl portion into the concave portion to be mixed with flush water spouted from the first spout port portion and flowing into the concave portion from the front of the bowl portion so that a circulating flow is formed in the concave portion, and pooled water can be stirred in the up-down direction by the circulating flow, thereby improving waste discharge performance.

In the present invention, preferably, the second spout port portion has an opening, an area of which is larger than an area of an opening of the first spout port portion.

In the present invention thus constituted, the opening surface area of the second spout port portion is larger than the opening surface area of the first spout port portion, therefore the flow rate of flush water spouted from the second spout port portion can reliably be made larger than the flow rate of flush water spouted from the first spout port portion so that a circulating flow is formed in the concave portion, and stirring of pooled water in the up-down direction by the circulating flow is enabled so that waste discharge performance can be improved.

In the present invention, preferably, a ratio of the area of the opening of the first spout port portion to the area of the opening of the second spout port portion is 1:2-10.

In the present invention thus constituted, the ratio of the area of the opening of the first spout port portion to the area of the opening of the second spout port portion is 1:2-10, therefore even if the second water conduit has a flow path shape with a high friction resistance to flush water, the flow rate of flush water spouted from the second spout port portion can reliably be made larger than the flow rate of flush water spouted from the first spout port portion so that a circulating flow is formed in the concave portion, and stirring of pooled water in the up-down direction by the circulating flow is enabled so that waste discharge performance can be improved.

In the present invention, preferably, the second spout port portion has a height of the opening which is larger than a height of the opening of the first spout port portion.

In the present invention thus constituted, the opening height of the second spout port portion is higher than the opening height of the first spout port portion, therefore the drop of flush water spouted from the second spout port portion relative to the shelf portion increases, making it easier for flush water to flow directly into the concave portion so that pooled water can be more effectively stirred in the up-down direction, and waste discharge performance can be improved.

In the present invention, preferably, the second water conduit has a cross section perpendicular to a flow line close to the second spout port portion, a width of the cross section widening toward the second spout port portion.

In the invention thus constituted, the second water conduit has a cross section perpendicular to a flow line close to the second spout port portion, a width of the cross section widening toward the second spout port portion, therefore flush water spouted from the second spout port portion can easily spread out in the horizontal direction, flush water can be more reliably made to flow down in the concave portion from the back and, as a result, a circulating flow is formed inside the concave portion, enabling pooled water to be stirred in the up-down direction by the circulating flow, and improving waste discharge performance.

In the present invention, preferably, the second water conduit is formed to be a U-shape having an inside wall on a bowl portion side and an outside wall on an bowl portion outside, and in an upstream part in front of a return of the U-shape, a curvature radius of the outside wall widens toward the downstream side or the outside wall extends in an essentially straight line form.

In the present invention thus constituted, a curvature radius of the outside wall widens toward the downstream side or the outside wall extends in an essentially straight line form, therefore flush water spouted from the second spout port portion can easily spread out in the horizontal direction, flush water can be more reliably made to flow down in the concave portion from the back and, as a result, a circulating flow is formed inside the concave portion, enabling pooled water to be stirred in the up-down direction by the circulating flow, and improving waste discharge performance.

In the present invention, preferably, in the upstream part in front of the return of the U-shape, the inside wall of the second water conduit is formed to be parallel or moving away from the outside wall.

In the present invention thus constituted, the inside wall of the second water conduit is formed to be parallel or moving away from the outside wall, therefore flush water spouted from the second spout port portion can easily spread out in the horizontal direction, flush water can be more reliably made to flow down in the concave portion from the back and, as a result, a circulating flow is formed inside the concave portion, enabling pooled water to be stirred in the up-down direction by the circulating flow, and improving waste discharge performance.

Advantageous Effects of the Invention

According to the flush toilet of the present invention, stirring in the up-down direction of pooled water in the concave portion of the bowl portion can be promoted and waste discharge performance is improved.

DETAILED DESCRIPTION

Figure 1:
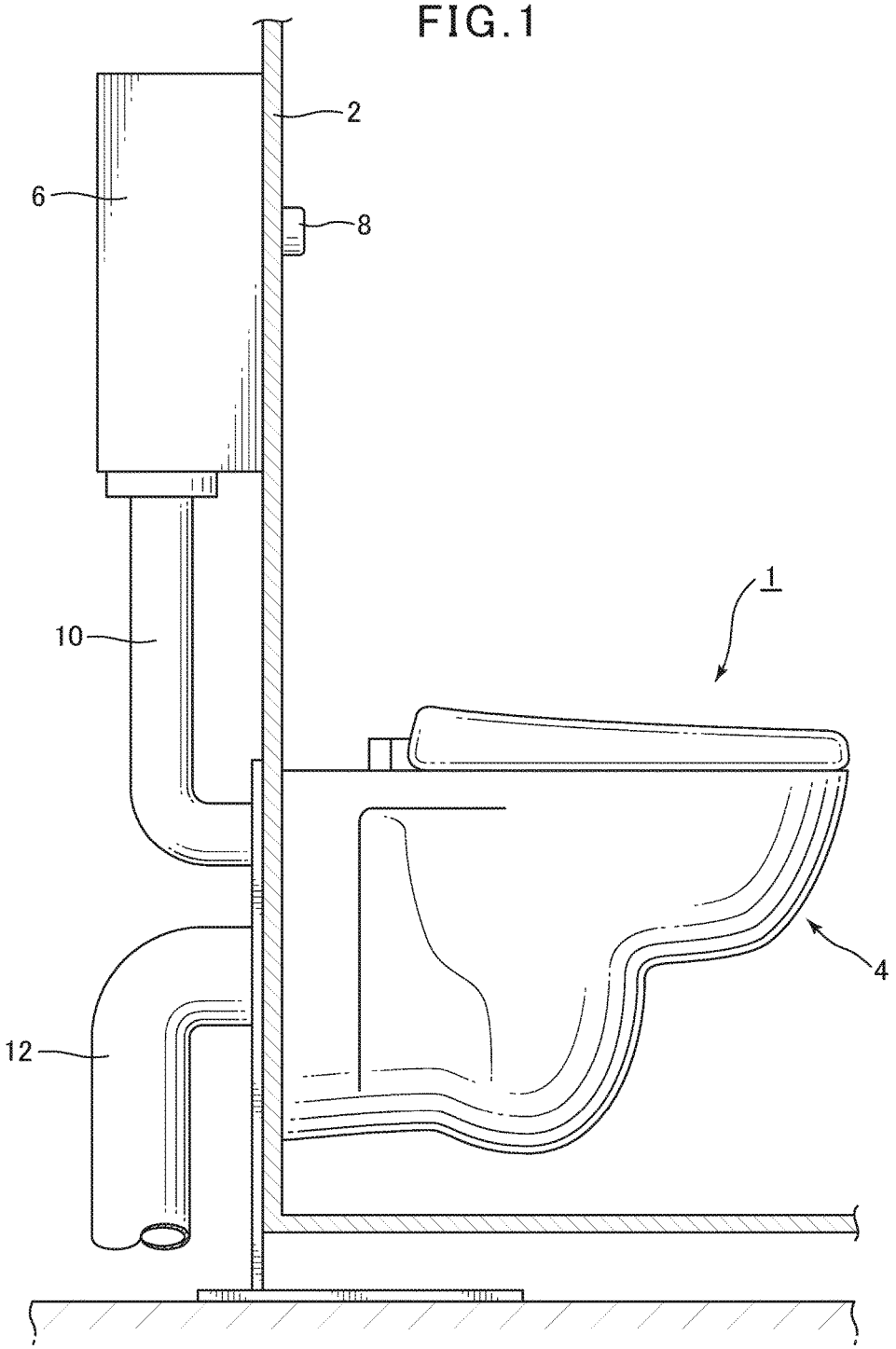
FIG. 1 is an overview summary showing a flush toilet according to an embodiment of the present invention.

Below, referring to the attached figures, a flush toilet according to embodiments of the present invention will be explained. FIG. 1 is an overview summary showing a flush toilet according to an embodiment of the present invention.

The flush toilet according to an embodiment of the present invention is a wash-down type flush toilet in which waste is pushed out by the flow action caused by the dropping or head of water inside the bowl portion. Note that the present embodiment can also be applied to siphon-type flush toilets, etc. in addition to wash-down type toilets.

As shown in FIG. 1, a flush toilet 1 according to an embodiment of the present invention comprises a toilet main unit 4 attached to a wall surface 2, and a storage tank 6 for storing flush water, being a flush water source attached to the upper rear side of the wall surface 2. Also, an operating switch 8 is attached to the front side of the wall surface 2. The storage tank 6 and the toilet main unit 4 are connected by a connecting pipe 10, and when the operating switch 8 is turned ON, flush water in the storage tank 6 passes through the connecting pipe 10 and is supplied to the toilet main unit 4.

In addition, a discharge pipe 12 for discharging waste is attached to the rear side of the wall surface 2; the discharge pipe 12 is connected to the toilet main unit 4 so that waste in the toilet main unit 4 is discharged.

Figure 2:
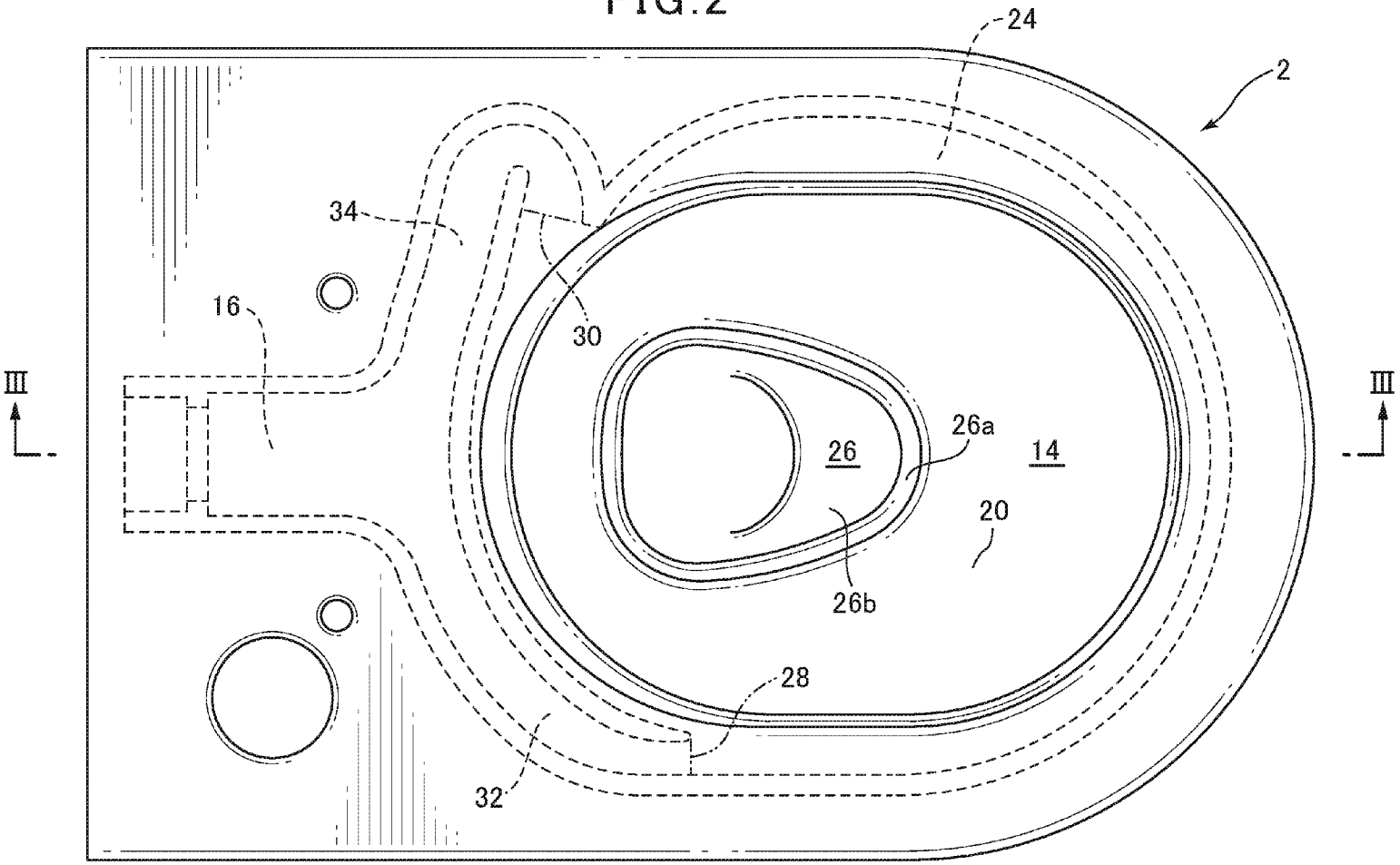
FIG. 2 is a plan view showing the toilet main unit of a flush toilet according to an embodiment of the present invention.
Figure 3:
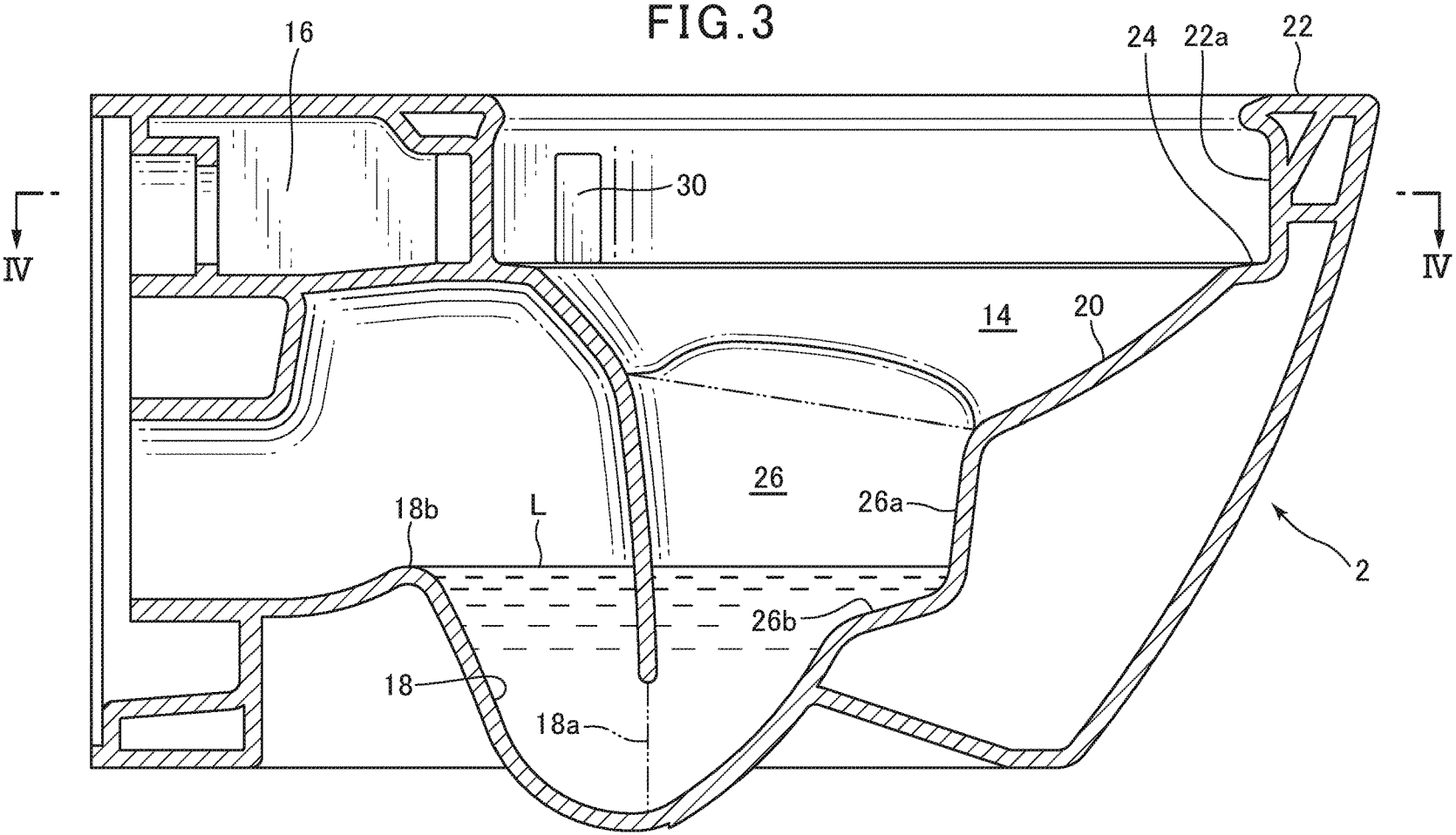
FIG. 3 is a cross sectional view of a flush toilet seen along a line III-III in FIG. 2.

Next, referring to FIGS. 2 and 3, the structure of a toilet main unit in a flush toilet according to an embodiment of the present invention is explained. FIG. 2 is a plan view showing the toilet main unit in a flush toilet according to an embodiment of the present invention; FIG. 3 is a cross sectional view of a flush toilet seen along a line III-III in FIG. 2.

As shown in FIGS. 2 and 3, in the toilet main unit 4 of the flush toilet 1 according to an embodiment of the present invention, a bowl portion 14 is formed at the front, a shared water conduit 16 for supplying flush water from the storage tank 6 to the bowl portion 14 is formed at the rear top portion thereof, and a discharge trap pipe or passage 18 for discharging waste is formed at the rear bottom portion thereof.

The bowl portion 14 comprises a bowl-shaped waste receiving surface 20, a rim portion 22 formed at the top portion of the waste receiving surface 20, a shelf portion 24 formed between the rim portion 22 and the waste receiving surface 20, and a concave portion 26, formed at the bottom of the waste receiving surface 20, to form a pooled water portion. The shelf portion 24 is formed to be essentially horizontal, and has the purpose of causing flush water to circulate; it essentially encircles the outside wall of the waste receiving surface 20. An inside perimeter surface 22*a* extending from the outside end of the shelf portion 24 in the vertical direction is formed on the rim portion 22.

In addition, a first spout port 28 is formed slightly to the rear of the center portion on the left side as viewed from the front of the inside perimeter surface 22*a* of the rim portion 22 on the bowl portion 14, and a second spout port 30 is formed at the rear side of the right side bowl portion 14 as viewed from the front. The first spout port 28 spouts flush water on the shelf portion 24 toward the front of the bowl portion 14. The second spout port 30 spouts flush water toward the rear of the bowl portion 14, forming a circulating flow in the same counterclockwise direction by the first spout port 28 and the second spout port 30.

Here the flush toilet 1 according to the present embodiment does not comprise a jet spout port for directly jetting and supplying flush water to the concave portion 26 of the bowl portion 14 or to the inlet 18*a* of the discharge trap pipe 18 described below.

The shared water conduit 16 branches toward the front of the toilet into a first water conduit 32 and second water conduit 34. Flush water is supplied to the first spout port 28 by the first water conduit 32, and flush water is supplied to the second spout port 30 by the second water conduit 34.

Note that in the flush toilet 1 according to the present embodiment, the first water conduit 32 including the first spout port 28 and the second water conduit 34 including the second spout port 30 are integrally formed as one piece with the ceramic toilet main unit 4, but the present invention is not limited to such flush toilets, and it is also possible to form the first water conduit and second water conduit using a distributor or the like, separate from the toilet main unit.

The concave portion 26 of the bowl portion 14 described above is triangular as viewed in plan; the front side has a tapered shape and the rear side has an arc shape. Also, the concave portion 26 comprises a vertical wall surface 26*a* disposed along the entire perimeter and a bottom surface 26*b* disposed on the front part.

The discharge trap pipe 18 described above extends diagonally upward from the inlet 18*a* opened in the bottom portion of the second spout port 30, passes through a highest point 18, then extends rearward and is connected to the discharge pipe 12.

Here the pooled water level L in the flush toilet 1 is determined according to the height of the highest point 18 in the discharge trap pipe 18.

Figure 4:
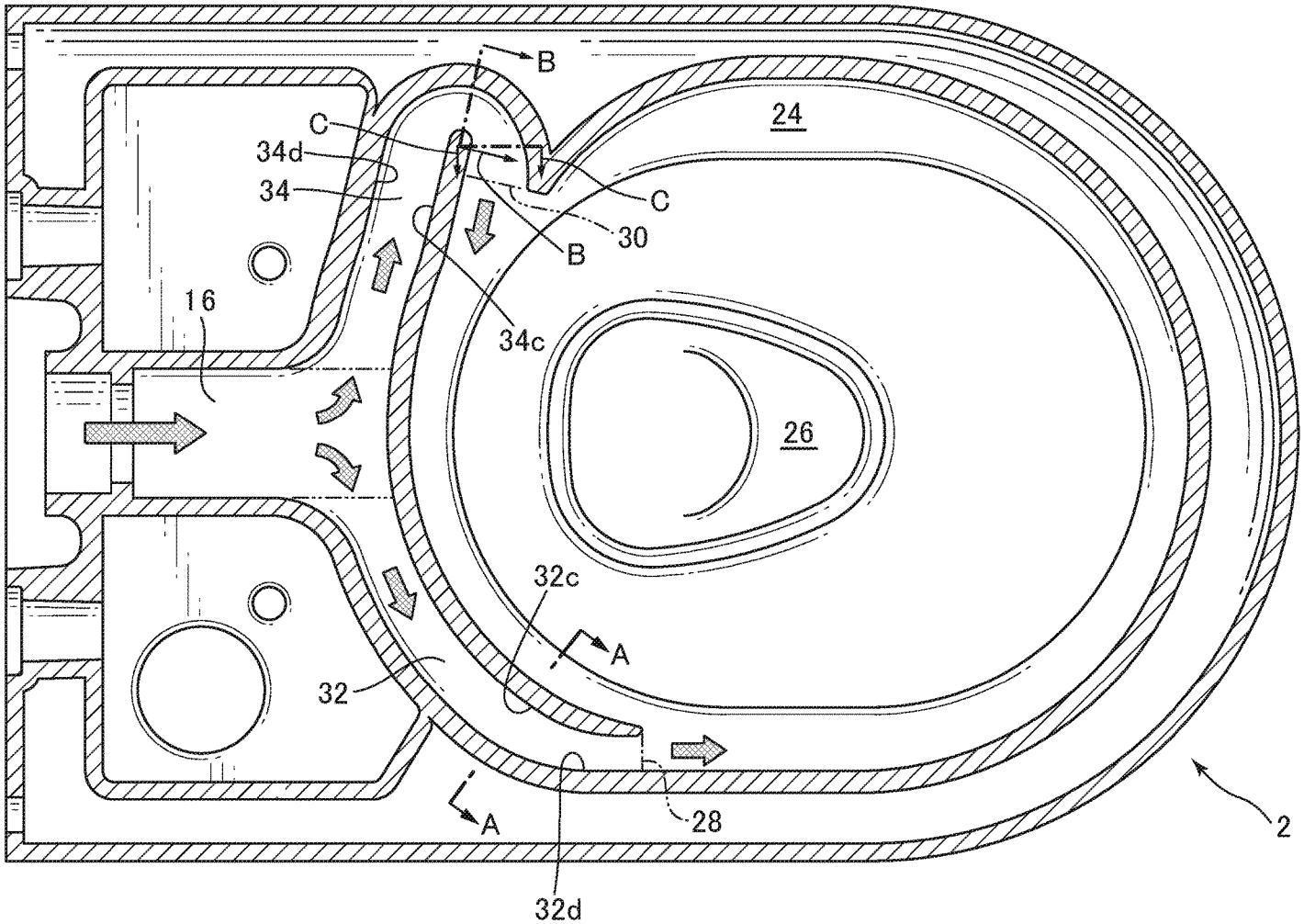
FIG. 4 is a cross sectional view of a flush toilet seen along a line IV-IV in FIG. 3.
Figure 5A:
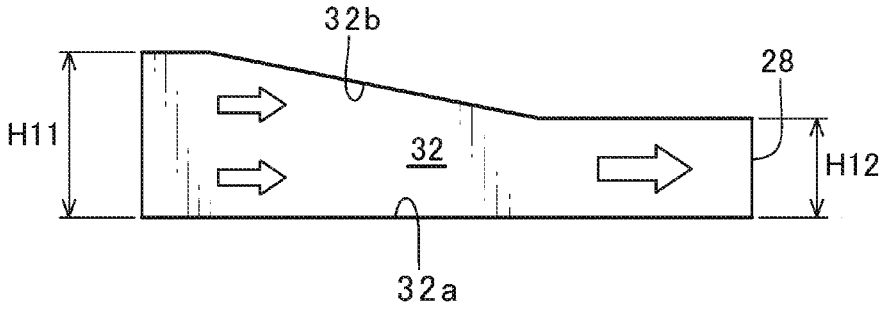
FIG. 5A is a cross sectional view along the flow line inside the first water conduit of a flush toilet according to an embodiment of the present invention.
Figure 5B:
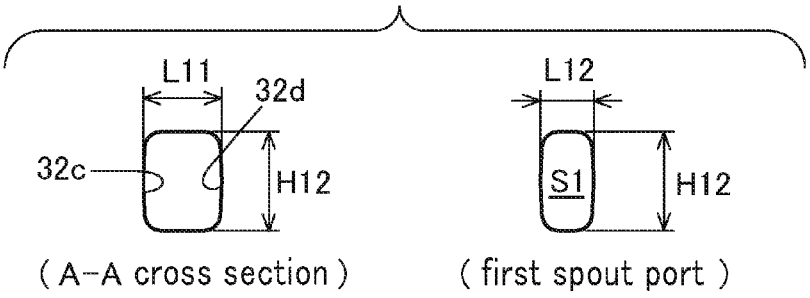
FIG. 5B is a cross sectional view in the direction perpendicular to the flow line inside the first water conduit of a flush toilet according to an embodiment of the present invention.
Figure 6A:
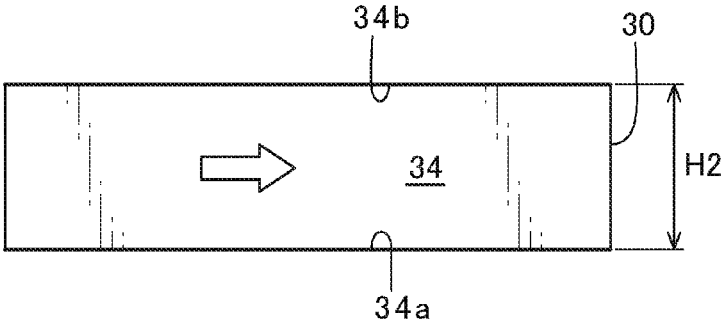
FIG. 6A is a cross sectional view along the flow line inside the second water conduit of a flush toilet according to an embodiment of the present invention.
Figure 6B:
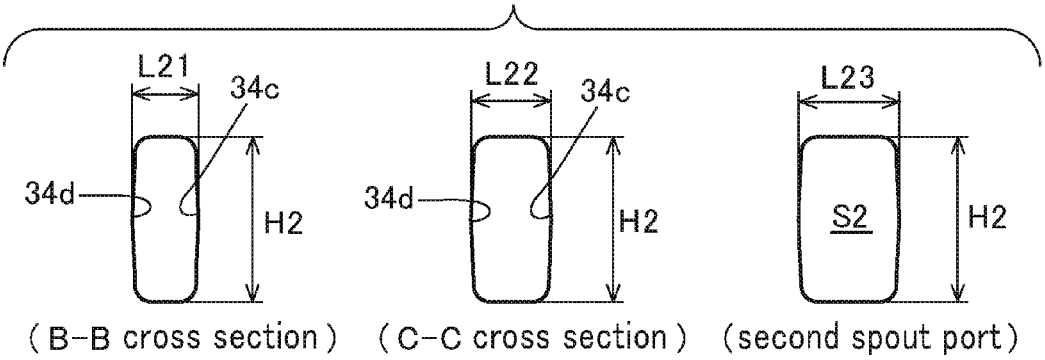
FIG. 6B is a cross sectional view in the direction perpendicular to the flow line inside the second water conduit of a flush toilet according to an embodiment of the present invention.

Next, using FIGS. 4 through 6B, details of the above-described first water conduit 32 and second water conduit 34 are explained. FIG. 4 is a cross sectional view of a flush toilet seen along a line IV-IV in FIG. 3; FIG. 5A is a cross sectional view along the flow line in the first water conduit in a flush toilet according to an embodiment of the present invention; FIG. 5B is a cross sectional view in the direction perpendicular to the flow line inside the first water conduit of a flush toilet according to an embodiment of the invention; FIG. 6A is a cross sectional view in a direction along the flow line in a second water conduit in a flush toilet according to an embodiment of the present invention; and FIG. 6B is a cross sectional view in the direction perpendicular to the flow line inside the second water conduit of a flush toilet according to an embodiment of the present invention.

As shown by FIGS. 4 through 5B, the first water conduit 32 is formed by a bottom surface 32*a*, a ceiling surface 32*b*, an inside wall 32*c*, and an outside wall 32*d*; the cross section perpendicular to the flow line (see FIG. 5(*b*)) has a rectangular shape. In the first water conduit 32, the bottom surface 32*a* is formed flat at a certain level; the shape of the ceiling surface 32*b* drops toward the downstream side; in the region close to the first spout port 28, the ceiling surface 32*b* is essentially parallel to the bottom surface 32*a* (see FIG. 5(*a*)). Also, the width of the first water conduit 32 (distance between the inside wall 32*c* and outside wall 32*d*) is essentially fixed, but in the region close to the first spout port 28 becomes gradually smaller (see FIGS. 4 and 5B). Although this is only example, the height H11 of an inlet of the first water conduit 32 is 50 mm, and the height H1 of the first spout port 28, which is the outlet from the first water conduit 32, is 30 mm.

As shown by FIGS. 4 and 6A, 6B, the second water conduit 34 is also formed by a bottom surface 34*a*, a ceiling surface 34*b*, an inside wall 34*c*, and an outside wall 34*d*; the cross section perpendicular to the flow line (see FIG. 6(*b*)) has a rectangular shape. The second water conduit 34 has a U-shape which returns 180° in front of the vicinity of the second spout port 30 (see FIG. 4). The second water conduit 34 is essentially parallel to the bottom surface 34*a* and the ceiling surface 34*b*, and maintains the same height H2 (see FIG. 6A).

As shown in FIG. 4, the outside wall 34*d* of the second water conduit 34 is essentially arc-shaped, but in the upstream part in front of the U-shaped return, the curvature radius thereof widens toward the downstream or extends in that straight line. The inside wall 34*c* of the second water conduit 34 is formed to be either parallel or moving away from the outside wall 34*d* in the upstream part in front of the U-shaped return.

In the downstream part of the second water conduit 34 U-shaped return, i.e. in the region close to the second spout port, the cross section surface area gradually expands. Specifically, as shown in FIG. 6A the height H2 of the second water conduit 34 is fixed and, as shown in FIGS. 4 and 6B, the width of the second water conduit 34 gradually expands. Specifically, as shown in FIG. 6B, in the region close to the second spout port of the second water conduit 34, the cross section surface areas are: a B-B cross section (L21×H2), a C-C cross section (L22×H2), and a first spout port cross section (L23×H2), gradually expanding.

In the flush toilet 1 of the present embodiment, the first water conduit 32 and second water conduit 34 are set so that the flow rate (L/min) of flush water spouted from the second spout port 30 is greater than the flow rate (L/min) of flush water spouted from the first spout port 28.

Because of this, the area of the opening of the second spout port 30 is set to be larger than the area of the opening of the first spout port 28. Preferably, a ratio of the area of the opening of the first spout port 28 to the area of the opening of the second spout port 30 is "the area of the opening of the first spout port:the area of the opening of the second spout port=1:2-10."

Note that in a flush toilet 1 according to the present embodiment, the second water conduit 34 has a U shape as described above, therefore friction losses result in a decline by that amount in the flow rate (L/min) of flush water spouted from the second spout port 30, but the second spout port 30 opening surface area is made sufficiently larger than the first spout port 28 opening surface area that the flow rate of flush water spouted from the second spout port 30 can be made larger than the flow rate of flush water spouted from the first spout port 28.

Figure 7:
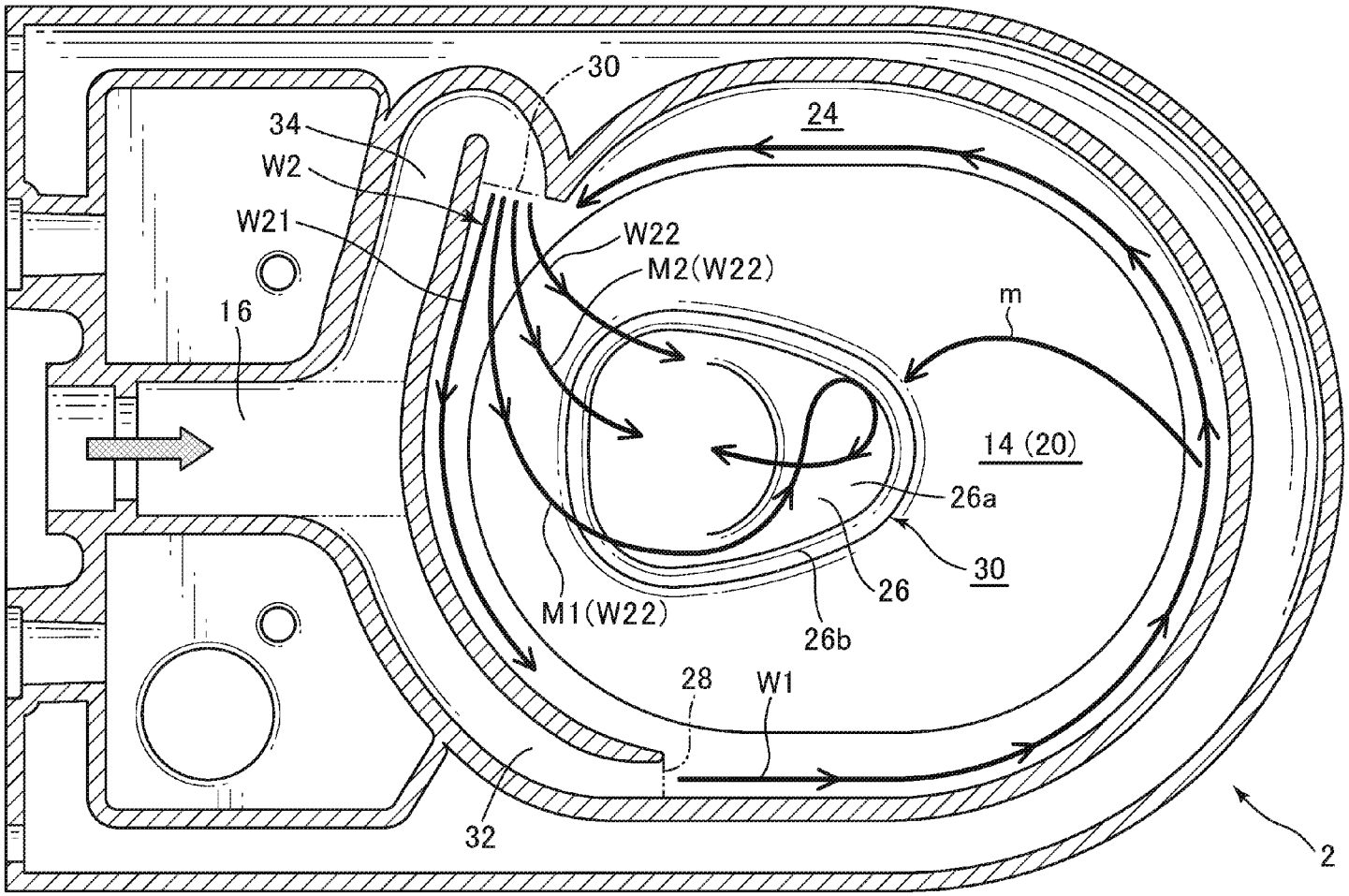
FIG. 7 is a plan view cross sectional view showing the flush water flow in a flush toilet according to an embodiment of the present invention.
Figure 8:
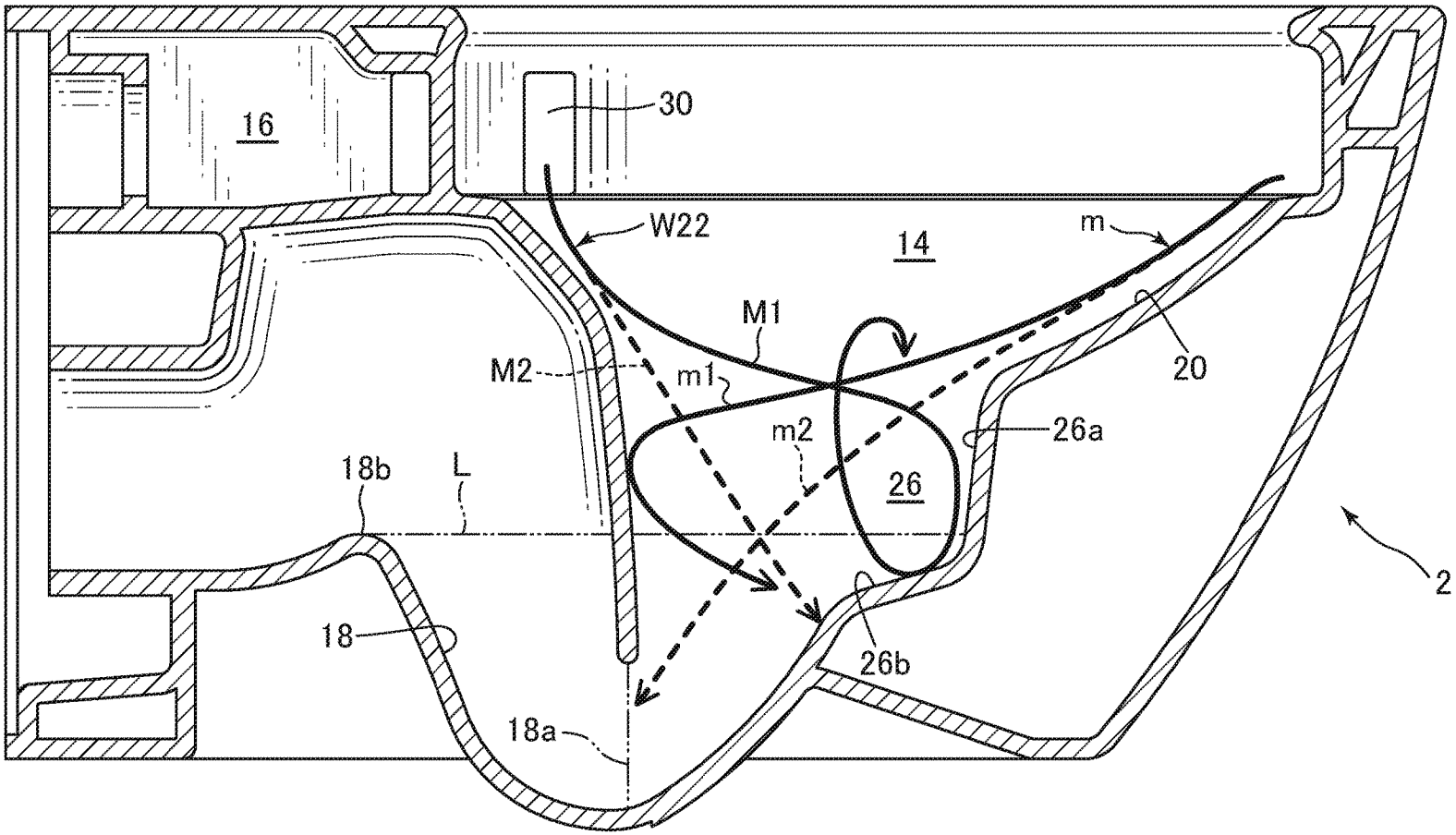
FIG. 8 is a side elevation cross sectional view showing the flush water flow in a flush toilet according to an embodiment of the present invention.

Next, referring primarily to FIGS. 7 and 8, the operation of a flush toilet according to an embodiment of the present invention is explained. FIG. 12 is a plan view cross sectional view showing the flow of flush water in a flush toilet according to an embodiment of the present invention; and FIG. 13 is a side elevation cross sectional view showing the flow of flush water in a flush toilet according to an embodiment of the present invention.

When a user turns the operating switch 8 (see FIG. 1) ON, flush water in the storage tank 6 flows through the discharge trap pipe 18 and into the shared water conduit 16, then branches from the shared water conduit 16, arriving at the first water conduit 32 and the second water conduit 34, to be spouted from the first spout port 28 and the second spout port 30, respectively.

Flush water W1 spouted from the first spout port 28 flows over the shelf portion 24 formed in the bowl portion 14. Specifically, it first flows toward the front of the bowl portion 14 and flows toward the rear after passing over the front end of the bowl portion 14. At this point, a part of flush water W1 flows down the waste receiving surface 20 as it circulates over the shelf portion 24, flushing the waste receiving surface 20.

The majority of flush water W1 spouted from the first spout port 28 and flowing on the shelf portion 24 (flush water m) flows from the front of the bowl portion 14 toward the inlet 18*a* on the discharge trap pipe 18. A part of flush water m collides with the rear surface of the concave portion 26 as flush water m1, then flows diagonally downward (see FIG. 8). m2, which is the remainder of flush water m1, flows directly into the discharge trap pipe 18 (see FIG. 8).

At the same time, the flow rate (L/min) of flush water W2 spouted from the second spout port 30 is greater than the flow rate (L/min) of flush water w1 spouted from the first spout port 28, therefore the flush water W2 flow is the main flow inside the bowl portion 14.

The flush water W2 spouted from the second spout port 30, which becomes the main flow, includes flush water W21 flowing on the shelf portion 24 and flush water W22 flowing directly down inside the concave portion 26 from the back of the concave portion 26. Specifically, flush water W21 flowing on the shelf portion 24 flows down the waste receiving surface 20 as it circulates over the shelf portion 24, primarily flushing the rear side of the waste receiving surface 20.

A part of the flush water W22 which has directly flowed down into the concave portion 26 (flush water M1) flows along the left vertical wall surface 26*a* of the concave portion 26 and sinks down to the bottom surface 26*b*. The flush water M1, which has sunk down to the bottom surface 26*b* of the concave portion 26, rises from the bottom surface 26*b* along the right side vertical wall surface 26*a* of the concave portion 26 and forms a vertical circulating flow which circulates in the up-down direction, effectively stirring the pooled water (see FIG. 8).

Flush water M1 mixes with the flush water m (m1, m2) spouted from the first spout port 28 and flowing in from the front of the concave portion 26; waste is by this means effectively stirred inside the concave portion 26, and can be smoothly discharged into the discharge trap pipe 18.

Also, flush water M2 flows directly into the inlet 18*a* of the discharge trap pipe 18 (see FIG. 8).

In a flush toilet 1 according to the above-described present embodiment, the second spout port 30 spouts flush water toward the rear of the bowl portion 14, and is formed so that the flow rate (L/min) of flush water spouted from the second spout port 30 is greater than the flow rate (L/min) of flush water spouted from the first spout port 28, therefore flush water spouted from the second spout port 30 becomes main flow W2; the main flow W2 flows directly into the concave portion 26 from the back of the concave portion 26 in the bowl portion 14 and is mixed with flush water m spouted from the first spout port 28 and flowing into the concave portion 26 from the front of the bowl portion 14; by this means a circulating flow is formed in the concave portion 26 so that pooled water can be stirred in an up-down direction by the circulating flow, and waste discharge performance can be improved.

Note also that a flush toilet 1 according to the present embodiment does not comprise a jet spout port for directly jetting and spouting flush water to the bowl portion 14 concave portion 26 or the discharge trap pipe 18 inlet 18*a*, therefore even if the flush water volume is reduced due to water conservation, a sufficient flow rate of flush water can be spouted from the first spout port 28 and the second spout port 30 that favorable flushing of the bowl portion 14 can be accomplished.

In a flush toilet 1 according to the present embodiment, the second spout port 30 opening surface area S2 is set to be larger than the first spout port 28 opening surface area S1, therefore the flow rate (L/min) of flush water spouted from the second spout port 30 can be reliably set to be greater than the flow rate (L/min) of flush water spouted from the first spout port 28, and as a result a circulating flow is formed in the concave portion 26; pooled water can be stirred in the up-down direction by the circulating flow, and waste discharge performance improved.

Using a flush toilet 1 according to the present embodiment, the ratio of the first spout port 28 opening area S1 to the second spout port 30 opening surface area S2 is 1:2-10, therefore even in a U-shape or the like where flush water friction resistance in the second water conduit 34 is high, the flow rate (L/min) of flush water spouted from the second spout port 30 can be reliably set to be greater than the flow rate (L/min) of flush water spouted from the first spout port 28, and as a result a circulating flow is formed in the concave portion 26; pooled water can be stirred in the up-down direction by the circulating flow, and waste discharge performance improved.

In a flush toilet 1 according to the present embodiment, the opening height H2 of the second spout port 30 is set to be higher than the opening height H12 of the first spout port 28, therefore the drop of flush water spouted from the second spout port 30 relative to the shelf portion 24 increases, and to that extent can more easily flow directly into the concave portion 26; pooled water can be more effectively stirred in the up-down direction, and waste discharge performance improved.

In a flush toilet 1 according the present embodiment, the second water conduit 34 has a the cross section perpendicular to the flow line close to the second spout port 30, and the width of the cross section widens toward the second spout port 30, therefore flush water spouted from the second spout port 30 can easily spread out in the horizontal direction, flush water can be more reliably made to flow down in the concave portion 26 from the back and, as a result, a circulating flow is formed inside the concave portion 26, enabling pooled water to be stirred in the up-down direction by the circulating flow, thereby improving waste discharge performance.

In a flush toilet 1 according to the present embodiment, the second water conduit 34 is formed to be the U-shape having a bowl-side inside wall 34*c* and an outer outside wall 34*d*; in an upstream part in front of a return of the U-shape, the curvature radius of the outside wall 34*d* expands toward the downstream, or the outside wall 34*d* extends in an essentially straight line, making it easier for the flush water spouted from the second spout port 30 to expand horizontally, so that flush water can be made to flow down inside the concave portion 26 from the back more reliably, resulting in the formation of a circulating flow inside the concave portion 26; pooled water can be stirred in the up-down direction by the circulating flow, and waste discharge performance improved.

In a flush toilet 1 according to the present embodiment, in the upstream part in front of the U-shape, the inside wall 34*c* of the second water conduit 24 is formed to be parallel or moving away from the outside wall 34*d*, therefore flush water spouted from the second spout port 30 can easily spread out in the horizontal direction, flush water can be more reliably made to flow down in the concave portion 26 from the back and, as a result, a circulating flow is formed inside the concave portion 26, enabling pooled water to be stirred in the up-down direction by the circulating flow, thereby improving waste discharge performance.

What is claimed is:

1. A flush toilet for discharging waste by using flush water supplied from a flush water source, comprising:

a bowl portion including a bowl-shaped waste receiving surface, a rim portion formed at a top portion of the waste receiving surface, a shelf portion formed between the rim portion and the waste receiving surface, and a concave portion formed at a bottom of the waste receiving surface;

a discharge passage for discharging waste, an inlet of the discharge passage being connected to a bottom of the bowl portion;

a first spout port portion for spouting flush water toward a front of the bowl portion onto the shelf portion of the bowl portion to form a circulating flow;

a second spout port portion for spouting flush water onto the shelf portion of the bowl portion toward a rear of the bowl portion in a same direction as the circulating direction of flush water spouted from the first spout port portion;

a first water conduit connected to the flush water source for supplying flush water to the first spout port portion; and a second water conduit, connected to the flush water source, for supplying flush water to the second spout port portion;

wherein the second spout port portion has an opening, an area of which is larger than an area of an opening of the first spout port portion so that flow rate of flush water spouted from the second spout port portion is greater than flow rate of flush water spouted from the first spout port portion; and wherein the flush water spouted from the second spout port portion is a main flow and the main flow flows directly from a back of the concave portion of the bowl portion into the concave portion to be mixed with the flush water spouted from the first spout port portion and flowing into the concave portion from a front of the bowl portion so that a concave portion circulating flow is formed in the concave portion, and pooled water can be stirred in an up-down direction by the concave portion circulating flow.

2. The flush toilet according to claim 1, wherein a ratio of the area of the opening of the first spout port portion to the area of the opening of the second spout port portion is 1:2-10.

3. The flush toilet according to claim 1, wherein the second spout port portion has a height of the opening which is larger than a height of the opening of the first spout port portion.

4. The flush toilet according to claim 1, wherein the second water conduit has a cross section perpendicular to a flow line close to the second spout port portion, a width of the cross section widening toward the second spout port portion.

5. The flush toilet according to claim 3, wherein the second water conduit is formed to be a U-shape having an inside wall on a bowl portion side and an outside wall on a bowl portion outside, and in an upstream part in front of a return of the U-shape, a curvature radius of the outside wall widens toward the downstream side or the outside wall extends in an essentially straight line form.

6. The flush toilet according to claim 5, wherein in the upstream part in front of the return of the U-shape, the inside wall of the second water conduit is formed to be parallel or moving away from the outside wall.

* * * * *